United States Patent [19]

Kaalstad et al.

[11] Patent Number: 4,549,614

[45] Date of Patent: Oct. 29, 1985

[54] DRILLING DEVICE

[75] Inventors: Oscar W. Kaalstad, Winter Park, Fla.; Neil G. Reid, Aylesbury, England

[73] Assignee: Engtech SA, Switzerland

[21] Appl. No.: 486,540

[22] PCT Filed: Jul. 26, 1982

[86] PCT No.: PCT/EP82/00158

§ 371 Date: Mar. 8, 1983

§ 102(e) Date: Mar. 8, 1983

[87] PCT Pub. No.: WO83/00524

PCT Pub. Date: Feb. 17, 1983

[30] Foreign Application Priority Data

Aug. 7, 1981 [CH] Switzerland ..... 5108/81
May 26, 1982 [CH] Switzerland ..... 3230/82

[51] Int. Cl.[4] ..... E21B 10/18

[52] U.S. Cl. ..... 175/339; 175/373; 175/400; 175/106; 175/291

[58] Field of Search ..... 175/106, 291, 334, 343, 175/339, 340, 376, 373, 408, 365

[56] References Cited

U.S. PATENT DOCUMENTS

| | | | |
|---|---|---|---|
| 1,124,243 | 1/1915 | Hughes | 175/365 |
| 1,152,151 | 8/1915 | Decker | 175/376 |
| 2,151,545 | 3/1939 | Zublin | 175/340 |

*Primary Examiner*—Stephen J. Novosad
*Assistant Examiner*—Michael A. Goodwin
*Attorney, Agent, or Firm*—Darby & Darby

[57] ABSTRACT

A drilling device comprises a drilling head including a rotating body through which runs a duct for supplying, under pressure, air, or mud, or water or other drilling fluid. At least one rotating cutting element is mounted on a shaft fixed on the rotating body so that the axes of rotation of the rotating body and of the cutting element diverge in the drilling direction. The cutting element is a disc having a ring-shaped cutting part. The rotating body bears on the opposite side to that bearing the rotating shaft of the disc a counter-reacting element placed in such a way that the element rests against the drilling wall to center the drilling head by compensating for the radial component of the reaction of the ground on the disc and to strengthen the wall. The point of contact of the element and wall which is highest up on the device is no higher than the highest point of the ring-shaped cutting part.

27 Claims, 10 Drawing Figures

Fig. 5
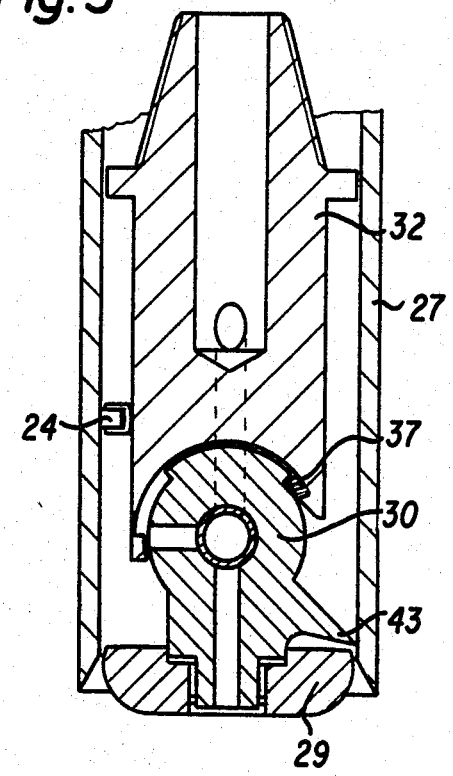
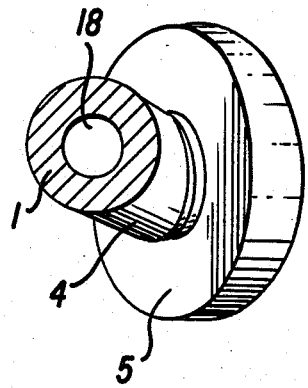
Fig. 10
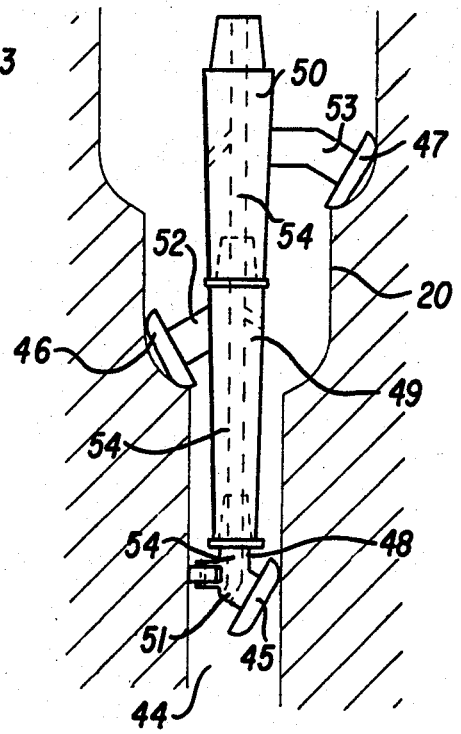
Fig. 6

DRILLING DEVICE

The present invention concerns a drilling device comprising a drilling head equipped with a rotating body through which runs a duct for supplying air and water or either drilling fluid and bearing at least one rotating cutting element.

Existing drilling devices comprising a drilling head equipped with three cutting elements markedly conical or in the shape of a truncated cone have been known and used since the 'thirties. The three theoretical tops of the cutting elements coincide with a point of the rotating shaft of the drilling head. The side of each cone is fitted with teeth of a size and sharpness appropriate to the type of ground to be drilled. Each cone is mounted on the drilling head in such a way that it rests on the ground following one of its generants and the teeth of one cone fit into the spaces between the teeth of the adjacent cone. The action of the three cones on the ground is the same as that of three rollers fitted with teeth. Each cone is retained radially by a shaft on which is mounted a ball bearing retaining the cone axially. During drilling, especially in the case of rocky ground, great pressure must be exerted to break the rock and subsequently cut it up and clear it away. With the three cones working along one of their generants, the working surface is large and great weight must be brought to bear on the drilling head to obtain the necessary pressure. The ground undergoes great compression which has the effect of breaking the rock, especially in the case of a rock cracked, over a radially more extensive surface than that of the drilling, thus creating an irregular drilling profile and an unstable wall.

The continuous injection of any drilling fluid into the bottom of the hole ensures the evacuation of the excavated ground and rock cut up by the three cones. The diameter of the surface of the bottom of the hole is approximately the same as the diameter of the drilling head and the evacuation of excavated ground is only ensured if their dimensions allow them to pass between the periphery of the head and the wall of the hole. The pieces of rock must therefore be broken up until they can pass between the wall of the hole and the periphery of the drilling head, slowing up the progress of the drilling and allowing fine particles of the excavated rock conveyed by the drilling fluid to reach the drill bit bearings, so destroying them.

Replacing a cone in case of breakdown takes a long time because the bearing must be removed to take off the cone.

The construction of a drilling head equipped with a semisphere fixed to a shaft almost perpendicular to the axis of the rotating body has already been suggested. The circumference of the disc is fitted with means to cut and profile the wall while the spherical surface which rests against the bottom of the hole to break by compression the bottom and the pieces cut out by the edge of the disc.

The invention aims to make it possible to produce a drilling device operating at low power, the cutting element being easily mounted on the drilling head and enabling the evacuation of larger pieces of debris.

The drilling device according to the invention is characterized by the fact that the cutting element is a disc provided with at least a ring-shaped cutting part and that the rotating body bears, on the side opposite to that carrying the rotating shaft of the disc, at least one counter-reacting element and placed so that the said element rests against the drilling wall to centre the drilling head by compensating for the radial component of the reaction of the ground on the disc and to strengthen the wall.

The counter-reacting element serves to stabilize the drill bit which could tend to oscillate around the drill shaft and to slightly offset the lower point of the cutting surface in relation to the drilling axis.

Because the disc acts on the wall to be cut by a ring-shaped surface equipped with cutting means, the action of the disc is to shear the wall and not to compress it in order to obtain its disintegration. There is certainly a slight compression by the disc at the very bottom of the hole but it is not essential to the working of the device. Moreover, the counter-reacting element resting against the opposite wall allows for centering of the tool and compensates for the radial reaction of the wall which has a tendency to resist the disc. The power needed for drilling is relatively low, the drilling being achieved by shearing and not by compression. In this way one obtains a more stable wall. Because the wall is less likely to give way than when using a conventional drilling head, the cost of installing tubes to prevent the wall from collapsing can be reduced. The cutting disc rests only on part of the hole bottom, less than half, and it leaves ample space for the evacuation of large pieces of excavated rock.

According to another version, and for those cases when it is essential to use tubes to support the wall of the drilled hole, the shaft of the disc is mountd on a hinged arm so that the drilling head can be inserted or removed through the tubes. The movement of the hinge is around an axis perpendicular to the rotating axis of the drilling head. In order to insert or remove the drilling head through the rubes, the rotating shaft of the cutting disc is moved, by pivoting the hinged arm, to a position forming an extension of the axis of rotation of the drilling head, the diameter of the tubes being at least equal to that of the disc. Elastics pull the rotating shaft of the disc back into an inclined position after the drilling head has passed through the tubes. Thanks to this device, the drilling head can be removed for repairs or sharpening without having to remove the tubing which would cause the wall to collapse and the partial reblocking of the hole. This device also enables the cutting disc to be changed if, at a certain depth, the type of ground changes, going, for instance, from a layer of sand to a much harder layer. In this way, time is saved. In this case, the counter-reacting element is mounted on a radially extensible arm.

According to another version, the drilling head is equipped with at least two cutting discs placed alternately on either side at regular intervals along the rotating body. Since the head is mostly used to enlarge the diameter of a previously drilled hole, the dimensions of a cutting disc and/or the length of its rotating shaft are greater than those of the preceding disc and smaller than those of the following disc, going from the lower end to the upper end of the rotating body. Finally, in the case of enlargement of the diameter of the hole, the lower drilling device which serves only as a guide can be a conventional drill-bit. The cutting surface of the disc can be approximately the shape of a truncated cone or a spherical ring.

According to another variation in design, the cutting disc is driven in rotation independently of the rotation of the main shaft, thus increasing its cutting effect which makes it possible both to speed up the drilling work and to diminish further the pressure exerted parallel to the drilling direction.

According to a variation, the compensating element is a roller having an elliptical section perpendicularly to the drilling axis. The advantage of this roller, which actually does not continually roll but rubs against the cut wall, is that it permits automatic centering of the bit even in places where the wall of the hole is cut into more deeply due to the instability of the ground or because a larger piece of rock is cut out. In fact, one can consider that in normal conditions the roller rubs against the wall with part of its side surface perpendicular to the small axis of the ellipse and that when the roller, because of an irregularity in the wall, will no longer be in contact with the wall, the drill bit will be put off centre under the effect of the reaction of the wall on the cutting disc until the roller again comes into contact with the wall and at that time will re-centre the bit by rolling on its side surface and pushing the disc against the wall. Of course, the depth of the irregularity should not be greater than the difference in length between the half of the small and larger axes of the ellipse. The movement of the roller is less than 90°. As soon as the disc comes into contact with the wall, the roller no longer rolls but merely rubs against the wall with a part of its side surface which is further away from the roller spindle than the part considered in normal conditions.

Preferably the roller is in flexible material and its side surface in a hard material, A roller with circular section mounted radially on an extensible arm can be used.

According to a preferred version, the counter-reacting element is a simple friction surface mounted on a radial arm.

The attached diagram shows, as an example, five different versions of the invention.

FIG. 5 is a longitudinal section of the device shown in FIG. 3 in the retracted position.

FIG. 6 is a schematic view of a drilling head designed to enlarge an existing boring/drilling.

FIG. 10 is a fragmentary sectional view from above illustrating an embodiment of the invention wherein the axis of rotation of the cutting disc is displaced in relation to the axis of the rotating body.

The drilling head (FIG. 1) comprises a rotating body 1 which screws on to the end of a shaft, not shown, driven in rotation. The upper part of the rotating body 1 has a part in the shape of a truncated cone 2 fitted with a thread 3.

Figure 1:
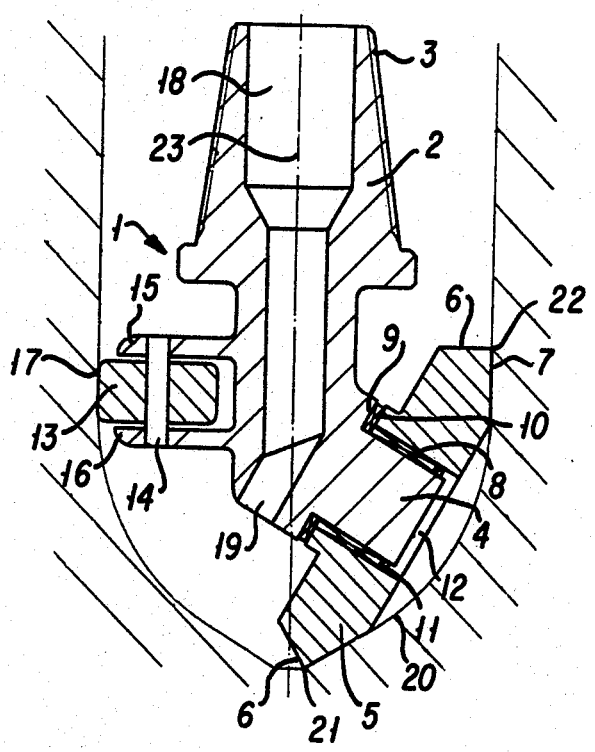
FIG. 1 is a longitudinal section of one version, including a rotating body, a cutting disc and a counter-reacting roller.

On the lower part of body 1 is a cylindrical section 4, the axis of which diverges downwards in relation to the axis of rotation of body 1. A disc 5 is fixed on the cylindrical part 4. The cutting surface of the disc has the shape of a truncated cone or, as shown in FIG. 1, it is composed of two opposed truncated surfaces 6 and 7. The ring-shaped surface 7 is equipped with cutting contrivances. The cylindrical part 4 serving as a rotating axis for the disc 5 is fitted with a ball-bearing 8 facilitating the rotation of disc 5. A shoulder 9 of the cylindrical part 4 serves as a thrust bearing for the disc and can also be fitted with a ball bearing 10. A nut 12 attaches the disc 5 on its shaft 4, a sealing lining 11 protecting the ball bearing 8 is placed between the nut 12 and the ball bearing 8. A roller on shaft 14 parallel to the axis of rotation of the drilling head is mounted between two horizontal plates 15 and 16 forming part of body 1. Generants 17 and 7 of the roller 13 and the disc 5, the furthest from the axis of rotation of the device, are diametrically opposed. It is possible to equip the device with other rollers placed at an angle or axially. A duct 18 runs through body 1 and out through a hole 19 in the drilled hole. The duct 18 serves to convey air, water or mud to the bottom of the hole to lubricate and cool the disc and to evacuate the excavated rock. The shaft 4 of disc 5 can also have a branch from duct 18 running through it and opening through a hole in nut 12. In this way, one obtains better cooling of the valid ball bearings 8 and the thrust bearing 10. The working surface of the disc can be fitted with ducts through which liquid is ejected under high pressure on to the surface to be cut. Depending on the nature of the ground, this liquid penetrates the wall and facilitates cutting. Drilling is carried out as follows: The body 1 is driven in rotation in the conventional way and a slight load is exerted on the drilling head. The side surface of disc 5, being equipped with teeth or being simply sharpened depending on the type of ground, shears the ground and creates a hole, the bottom of which has an axial section with an approximately parabolic profile 20.

If one considers the case of a disc fitted with teeth on the side and located in relation to its rotating shaft, when the head turns the teeth cut out a series of steps. Because of the load exerted on the drilling head, the disc penetrates in proportion to the rotation and the horizontal side of the step created by one tooth is sheared by an adjacent tooth describing a circumference bigger than that of the circumference described by the preceding tooth. If, however, the disc 5 is in free rotation around its shaft and the vectorial sum of the forces exerted on its cutting surface not being nil, the resulting torque drives disc 5 in rotation around its shaft 4. In this way, each point of the wall is cut out under the effect of a force perceptibly perpendicular to the axis of rotation of the drilling head and at a tangent to the wall 30 and a force perpendicular to the rotating shaft 4 of the disc 5. These forces are due respectively to the rotation of the drilling head and to the free rotation of the disc 5.

Previously, and depending on the type of ground, a hole several centimeters deep must be drilled by other means so that a large part of the active surface of the cutting disc 5 is in contact with the ground. Without this precaution at the beginning of drilling, particularly on hard ground, the disc 5 tends to roll around its shaft 4, only a small part of its circumference being in contact with the ground. To ensure that the disc 5 rotates around its shaft 4 during drilling, the bottom point 21 on the lowest cutting edge must be at least 1 mm away from the geometric axis of rotation 23. During drilling, the roller 13 rests on the side of the hole and serves to counterbalance the reaction of the ground against the disc and to strengthen the wall.

Figure 2:
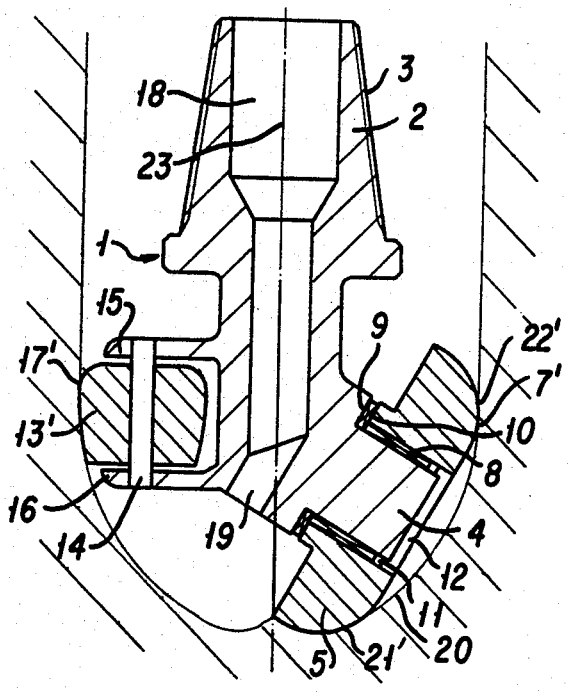
FIG. 2 shows the same version as FIG. 1, the cutting disc and the roller being different.

The version illustrated in FIG. 2 differs from the preceding version only in the shape of the roller and of the cutting surface.

In fact, the roller 13' has the shape of a truncated paraboloid to coincide with the wall at the bottom of the hole. Obviously, this same roller could replace roller 13 of the preceding version. For this version, the side surface 7 of the disc is in the shape of a spherical ring. The cutting surface in contact with the wall has a maximum diameter which can be defined on this Figure by the length of the segment connecting points 21' and 22'. Point 22' and point 17' of the roller can be at the same level, the position of the roller relative to the disc should be such that the bit remains in equilibrium during driling, in other words that it does not oscillate around the drill shaft. Point 17' is the highest point of the roller 13 in contact with the wall. It seems that the optimum length of the greatest diameter of the cutting surface is that corresponding to the length of the side of an equilateral triangle inscribed in a circle having the same diameter as the drilling diameter. This length is represented on FIGS. 1 and 2 by segments 21–22, respectively 21'–22'.

For the rest of FIG. 2, the same references indicate the same elements previously described. The distance from point 21' to the centre of the hole is greatly exaggerated on the drawing. In reality it is a few millimeters and the point resting at the bottom of the hole is crushed by the side surface of the disc. Moreover, this point serves to keep the drilling head centred and in this case the roller or the counter-reacting element is not in continuous contact with the drilling wall. The cutting surface can be profiled so that as the ring-shaped cutting surfaces (with or without teeth) gradually wear, the adjacent surfaces take over the work while still continuing to impart the same profile to the drilled hole. In fact, the hole profile approximately in the form of a double parabola in FIG. 2 is desirable precisely because the middle point enables the bit to be automatically stabilized, the disc being in a position slightly off centre.

The rounded shapes both of the roller and its support and of the cutting disc facilitate the withdrawal of the bit.

Figure 3:
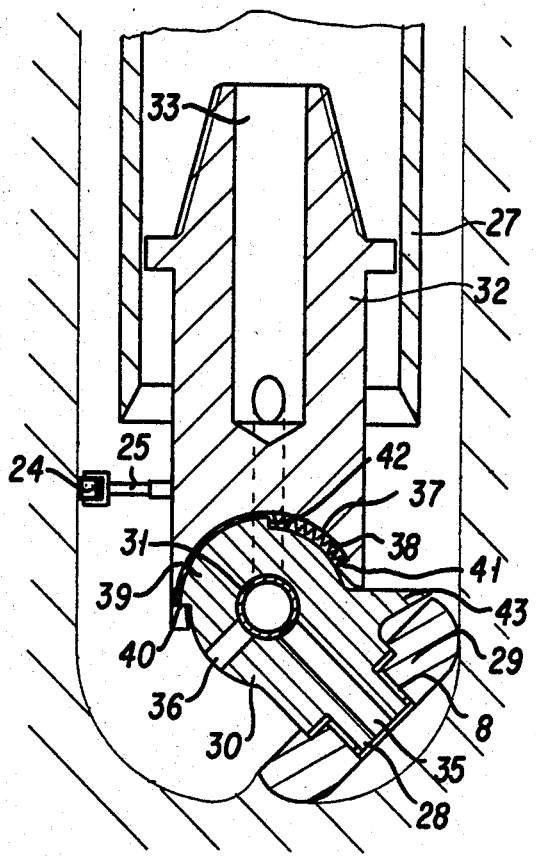
FIG. 3 is a longitudinal section of a hinged device.
Figure 4:
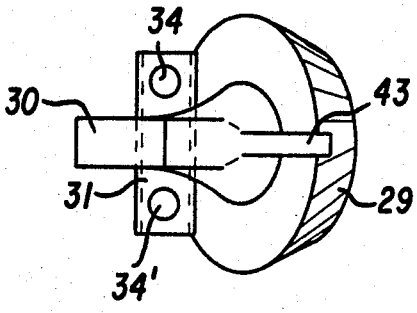
FIG. 4 is a view in plan of the lower part of the preceding Figure.

In cases where the walls of the hole must be consolidated with tubes 27 (FIG. 3), the shaft 28 of disc 29 is part of an arm 30 hinged around a shaft 31 perpendicular to the axis of rotation of the drilling head. Shaft 31 is mounted on a rotating cylindrical body 32 through which runs a duct 33 opening into the shaft 31 which is hollow. On the side of shaft 31 are two holes 34 and 34' (FIG. 4) opening into duct 33 by a bent tube (not shown) forming an inverted U, the extremities of the U being connected to the two holes 34 and 34' and the base of the U, which is equipped with a hole, to duct 33. Two other holes on the side of shaft 31 connect duct 33 with duct 35 running through shaft 28 of disc 29 and a second duct 36 of arm 30 when the drilling head is in working position as shown in FIG. 3. The articulated arm 30 has a cylindrical head through which passes shaft 31. On part of its side surface the head has a cylindrical tenon 39. The upper part of the head of arm 30 is lodged in a housing corresponding to the rotating body 32.

In the working position, one of the flat sides of the cylindrical tenon 39 knocks against a corresponding surface of the rotating body, thus ensuring the angular positioning of cutting disc 29. In a housing 38 between the head of the articulated arm and the drill shaft, a spring 37 resting on one side against a surface 41 of the drill shaft and, on the other side, against the second flat side 42 of the tenon 39, draws the shaft 30 back into working position. A small tongue 43 being horizontal in the working position knocks against the rotating body 32, also ensuring the angular positioning of disc 29 and, in addition, it knocks against the lower end of tubing 27 and draws shaft 28 of disc 29 into vertical position, as shown in FIG. 5, in order to enable the drilling head to be withdrawn from tubing 27. The end of the small tongue 43 rubs against the inner wall of tubing 27, ensuring the correct positioning of disc 29 when it moves inside the tubing.

During drilling, a roller 24 mounted on a radially extensible arm 25 rolls either against the wall of the drilled hole or against the inner wall of tubing 27. Its main purpose is to act as a counter-balance to the reaction of the ground to disc 29 and to centre the device. It also strenghthens the wall of the hole if it rolls outside the tubing 27. When the drilling head is inserted or removed through tubing 27, the extensible arm 25 is in retracted position to allow the device to pass through the tubing. Arm 25 can be a hydraulic jack. Preferably, the roller should be at the same level as the upper part of the cutting surface of the disc or even lower to ensure the stability of the drill bit.

FIG. 6 shows schematically a variation on the design allowing for the enlargement of the diameter of a hole 44 made by a drilling device corresponding to the bit described above of by another conventional means.

The device shown have three cutting disc 45,46,47 placed at intervals and alternately on either side of the rotating body. The diameter of the lower disc 45 is smaller than that of the second disc 46 which, in turn, is smaller than that of the third disc 47. The same applies to the length of their respective rotating shafts 51 to 53.

In order to standardize construction, it is possible either to have cutting discs of the same diameter and rotating shafts of different length, or vice versa. The rotating body supporting the three rotating shafts 51 to 53 of the cutting discs 45 to 47 can be made of a single piece but this design has the disadvantage of rigidity of use and especially in case of breakdown of one of the discs, the whole drilling head must be changed.

To avoid these disadvantages, each cutting disc 45 to 47 is mounted on its own drill shaft 48 to 50. The lower drilling element corresponds to the device in FIG. 1 and we will not describe it again. The shaft 49 which bears the disc 46 is attached on top of shaft 48 in such a way that the discs 45 and 46 are on opposite sides of the new shaft so obtained. To ensure the relative position of the two discs 45 and 46, the two shafts 48 and 49 must be attached by a bayonet or other system. The third shaft 50 is mounted on the second 49 in the same way but, this time, the cutting disc 47 is placed on the same side of the drill shaft as the first.

Each of the rotating bodies is equipped with an axial duct 54 for the passage of cooling fluids and for evacuating excavated rock. The axial ducts open into another and each has two branches, one running axially through the rotating shaft of the corresponding cutting disc (not shown), the other opening radially on to the side of the drill shaft.

During enlargement of the hole 44, the first drilling element serves only as a guide and counter-balance to the second, and so on. The first drilling element can be a conventional drill-bit having served to drill the hole 44.

In this last variation of design, it is possible to do without the rollers corresponding to the upper discs, each disc serving to counter-balance the other.

In order to avoid radial distortions of the common rotating body, the axial distance between two cutting discs should be limited.

It seems that if the distance between the levels of the highest point of the first disc 45 and the lowest point of the following disc 46 is equal to the diameter of the previously drilled hole, an acceptable distortion is obtained.

According to a variation of design in FIG. 10, it is possible to slightly displace the rotating shaft of the cutting disc 5 in relation to the axis of rotation of the rotating body 1 so that part of the cutting surface bears more heavily against the wall of the hole and facilitates the torque, tending to make the disc turn around its shafts. The angle defined by the shifted virtual axis of rotation of the disc and by the straight line passing through the centre of the disc and the point of intersection of the virtual axes of rotation of the rotating body and the nondisplaced disc should be between 1° and 5° to achieve the above-mentioned effect.

The drilling device described can be used for any sort of vertical, oblique or horizontal drilling in search of water, oil or form mining exploration and exploitation. A small amount of power being sufficient to operate the described device, it is very economic in use for underwater drilling where it is necessary to drill through layers of widely differing hardness, ranging from sand to the hardest rock. The same applies to horizontal drilling because a slight axial power is sufficient for good operation. It can be used to good advantage in the building of tunnels. Since the bearings are used only to facilitate the rotation of the disc, they can be ball, roller or needle bearings. They are mounted in such a way as to be water-tight which results in prolonging their life.

It has been established that, instead of roller bearings, plain bearings can be used which last longer.

The cutting surface can be either a hard surface or equipped with teeth made from diamond, tungsten carbide or other substances, their choice being dictated by the type of ground to be drilled.

Figure 7:
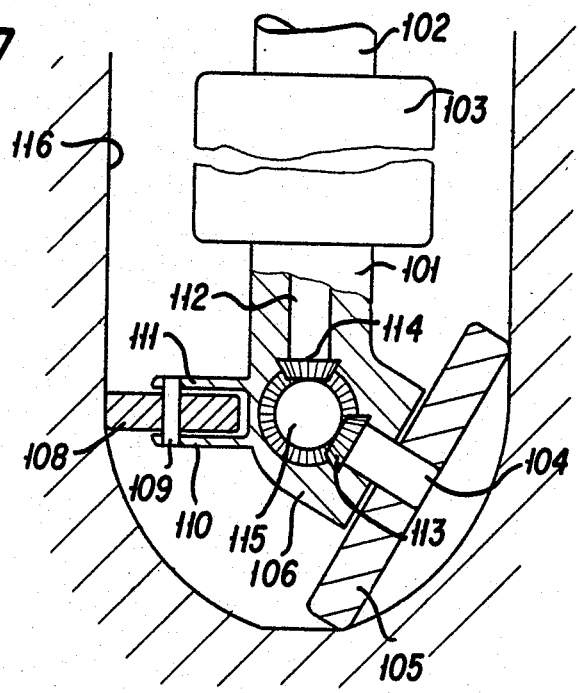
FIG. 7 is a diagram showing a longitudinal section and profile of a drill bit fitted with means for driving the cutting disc in rotation.

The speed at which the disc rotates around its shafts, for the versions already described, depends on the speed of rotation of the shaft of the drilling device on which the drill bit is fixed and on the vectorial resultant of the forces exertes on the surface of the disc. This dependence reduces the cutting action of the disc and prolongs working time and also causes asymmetrical wear of the cutting disc. The version in FIG. 7 enables these disadvantages to be remedied.

The drill bit comprises a rotating body 101 screwed to the end of the shaft 102 bearing a motor unit 103. A cutting disc 105, illustrated altogether diagrammatically, is mounted on an oblique shaft 104 housed in an oblique part 106 of the rotating body 101. A roller 108 is fitted on the side diametrically opposed to the oblique part 106 of the rotating body, its shaft 109 being borne by two parallel arms 110 and 111. The disc 105 is kinematically connected to the motor 103 by the intermediary of two spindles 104 and 112 each fitted at one end with a bevel gear 113 and 114 respectively, the two gears 113 and 114 being connected by a toothed wheel 115. The drive shaft 112 independently of the rotation of shaft 102 drives the toothed wheel 115 in rotation which transmits motion to the spindle 104 which makes the disc 105 turn and which cuts into the wall 116 of the hole. The motor unit 103 can be a turbine driven by the liquid circulating inside a duct, not shown, of the shaft 102 and of the rotating body 101 intended for the evacuation of debris or any other kind of motor. The speed of rotation of the disc 105 being independent of the speed of rotation of the shaft, less pressure needs to be exerted on the bit. In fact, the cutting disc 105 works like a circular saw or a cutter, the main cutting effort being supplied by the disc's own rotation. According to the type of ground, the cutting disc is fitted with teeth made of diamond, tungsten or other hard material.

Using the same principle, a machine can be produced for horizontal drilling, to extract coal for example. The essential difference is that tunnels drilled for mining exploitation have a far greater diameter. All that needs to be done in such cases is to mount on the existing spindle of a tunnel drilling machine a rotating body whose oblique part is much longer than the oblique part 106 of the body 101 of FIG. 7 as well as the arm or arms bearing the compensating roller. The oblique part of the rotating body being longer, a motor for driving the disc can be fitted directly on to this part of the rotating body. The operation of such a device is the same except in dimensions as that of the device in FIG. 7.

In order to follow the irregularities of the diameter of the hole better, due to the nature of the ground, the roller can be mounted on an extending arm.

Figure 8:
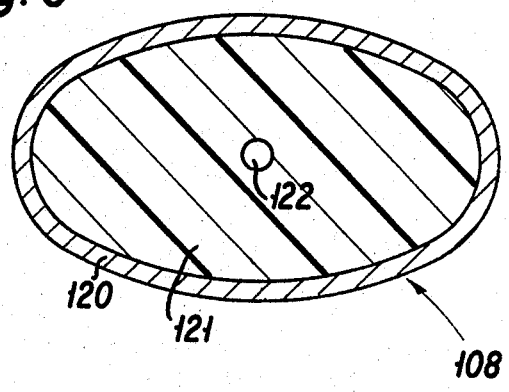
FIG. 8 is a view in plan of a compensating roller of a particular shape.

Another solution is to use a roller whose section perpendicularly to the drilling axis is elliptical (FIG. 8). The roller represented in FIG. 8 is formed of an elliptical ring 120 in hard material such as tungsten surrounding a core 121 made of another material, for instance rubber. Through this core 121 is a cylindrical hole 122 allowing for the passage of shaft 109 of the roller 108. This roller is designed to rub against the wall and to roll only where there is an irregularity in the wall until the disc 105 is in contact with the wall 116 of the hole. In fact, one can consider that the roller 108 rubs against the wall of the drilling hole with part of its side surface which is nearest to shaft 122 of the roller. As soon as the roller is no longer in contact with the wall because of an irregularity (hole) in the wall, the bit is de-centred under the effect of the reaction of the wall on the cutting disc 105. The roller then comes into contact with the wall and starts rolling until the cutting disc 105 is brought into contact with the wall. Of course, the variation in hole diameter must correspond to the difference in length between the half-small and the half-large axis of the ellipse in order to ensure efficient operation of the device. The roller returns to its original position as soon as the variation in the drilling diameter has been eliminated.

Figure 9:
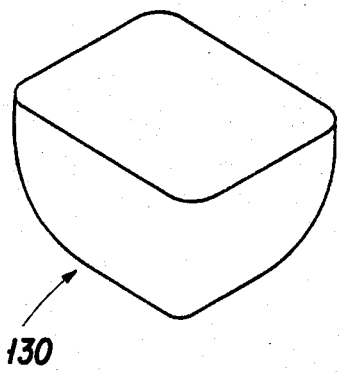
FIG. 9 is a perspective view of a compensating element of a particular shape.

Another solution which has also been tested is to use a friction surface mounted on an elastic support in place of the counter-reacting roller. This solution makes it possible to remedy the wear undergone by the shaft of the roller with the circular section which turns much faster than the drill bit. The friction surface can be the side surface of an approximately cylindrical or prismatic-guide fixed element. When the part of its surface in contact with the wall of the drilled hole has worn down, it can be turned so that an unworn part of the side surface faces the wall of the hole. Such an element-guide 130 is shown in FIG. 9. It consists of a prism, the edges and its side surface being rounded. The side surface can be fitted with flexible teeth to absorb the variations in the wall of the drilled hole. Element 130 is fixed and set parallel to the drilling shaft so that one of its side surfaces (or edges) is facing the wall of the hole. When this face or edge is worn, element 130 can be turned and one of the other surfaces or edges brought forward. This non rotating upper compensating guide which in effect is a pre-set (to one of a number of positions) curved surface able to touch against the side of the hole as cut by the lower disc. The compensating guide can be set to act only on the vertical wall of the hole or can be set at a lower level to impinge on the upper end of the curved base to the hole. The main objective of the upper compensating guide is to ensure that the lower disc is seated particularly at the start of any hole at a position causing a trench eccentric from the centre line of the hole.

We claim:

1. A drill bit for use in drilling a well bore, which comprises:

a main body adapted to be rotated and defining a duct extending substantially longitudinally therethrough for supplying a drill fluid under pressure to the well bore;

a cutting element rotatably mounted to the main body and having its axis of rotation disposed at an angle to the axis about which the main body rotates, the cutting element being a disc having a ring-shaped cutting portion; and a counter-reacting element mounted on the main body and positioned diametrically opposite the cutting element at substantially the same level as the cutting element, the counter-reacting element extending from the main body for a distance calculated to cause the cutting element to rest against the wall of the well bore.

2. Drilling device according to claim 1, characterized by the fact that the drill bit comprises means for rotatably driving the cutting disc independently of the rotation of the rotating body.

3. Device according to claim 2, characterized by the fact that the means for driving the cutting disc includes a motor integral with a rotating shaft bearing the drill bit and a device connecting the motor and the cutting disc kinematically.

4. Device according to claim 3, characterized by the fact that the motor is a turbine driven by a fluid circulating in the duct of the drilling device.

5. Device according to claim 2, characterized by the fact that the driving means are integral with the main body of the drill bit.

6. Device according to claim 1, characterized by the fact that the counter-reacting element is supported by an extensible radial arm.

7. Device according to claim 1, characterized by the fact that the greatest diameter of the ring-shaped cutting portion of the disc is approximately equal to the side of an equilateral triangle inscribed in a circle of the same diameter as the drilling diameter.

8. Device according to claim 1, characterized by the fact that the main body further includes an arm on which the disc is rotatably mounted, the arm being hinged around an axis perpendicular to the angle of rotation of the rotating main body so that the axis of rotation of the disc can be either at an angle to the rotating axis of the rotating main body or co-axial therewith.

9. Device according to claim 8, characterized by the fact that the hinged arm includes biasing means for selectively retaining the axial disposition of the disc at an angle to the rotating axis of the rotating main body.

10. Device according to claim 1, characterized by the fact that the drill bit further comprises at least two additional cutting discs rotatably mounted on the rotating main body at regularly spaced positions along its length and placed alternately on two diametrically opposed sides of the main body.

11. Device according to claim 10, characterized by the fact that the rotating body is formed from at least two rotating sub-bodies each bearing one of the at least two cutting discs and attached to each other end to end.

12. Device according to one of the claims 10 or 11, characterized by the fact that the respective diameters of the cutting discs increase progressively, the smallest dimensions corresponding to the lower cutting disc.

13. Device according to claim 10, characterized by the fact that the cutting discs project outwardly from the main body distances that progressively increase from the lower most cutting disc on the main body to the uppermost cutting disc.

14. Device according to claim 1, characterized by the fact that the lower point of the cutting surface of the disc situated at the lower end of the rotating main body is at a radial distance of at least 1 mm from the virtual rotating axis of said rotating main body.

15. Device according to claim 1, characterized by the fact the main body further includes a shaft on which the disc is rotatably mounted, the shaft having a duct running through it for supplying, under pressure, a drilling fluid emerging near the centre of the disc and for ejecting the fluid under pressure against the wall of the hole.

16. Device according to claim 1, characterized by the fact that the angle formed by the virtual displaced rotating axis of the disc and the straight line joining the centre of the disc to the point where the virtual rotating axes of the rotating main body and the disc would intersect if the latter were not displaced, is between 1° and 5°.

17. Device according to claim 1, characterized by the fact that the cutting surface of the disc is fitted with teeth situated in rings about the periphery of the disc, the cutting surface being in the form of a calculable surface enabling successive rings of the teeth to maintain the desired profile of the drilling wall even after the wear undergone by one of the rings of the teeth in contact with the material of the hole.

18. A drill bit as defined in claim 1 wherein the axis of rotation of the cutting element is disposed at an acute angle to the axis about which the main body rotates to cause the bit to form a contoured bottom in the wall bore, and wherein the counter-reacting element is further positioned in relation to the cutting element to contact a portion of the contoured bottom of the well bore.

19. A drill bit as defined in claim 18 wherein the axis of rotation of the cutting element forms an angle of about 60° with the axis about which the main body rotates.

20. A drill bit as defined in claim 18 wherein the counter-reacting element is a preset non-rotatable friction pad having a truncated parabolic shape in longitudinal section to conform to the contoured bottom of the well bore and to facilitate the withdrawal of the bit from the well bore.

21. A drill bit as defined in claim 1 wherein the main body further defines a nozzle communicating with the drilling fluid duct and disposed at an angle thereto, the nozzle being further positioned between the cutting element and the counter-reacting element at the bottom portion of the main body to project a stream of drilling fluid against the wall of the well bore.

22. A drill bit as defined in claim 1 wherein the counter-reacting element is a preset non-rotatable friction pad.

23. A drill bit as defined in claim 1 wherein the counter-reacting element is in the form of a roller.

24. A drill bit as defined in claim 1 wherein the counter-reacting element is a rotatable roller having an elliptical shape in section.

25. A drill bit as defined in claim 1 wherein the axis of rotation of the cutting element is disposed in relation to the axis about which the main body rotates to bring the lower edge portion of the cutting element in contact with the bottom of the well bore near the center thereof and to bring the upper edge portion of the cutting element in contact with the substantially straight side walls defining the well bore.

26. A drill bit as defined in claim 1 wherein the cutting element is a rotatable disc, the disc having a plurality of teeth disposed about the periphery thereof to aid in grinding material sheared from the side walls and bottom of the well bore by the disc.

27. Device according to claim 1, characterized by the fact that the cutting surface of the disc is profiled in segmented portions situated in rings about the periphery of the disc, the cutting surface being in the form of a calculable surface enabling successive rings of the cutting surface portions to maintain the desired profile of the drilling wall even after the wear undergone by one of the rings of the cutting surface portions in contact with the material of the hole.

* * * * *